US010182287B2

(12) United States Patent
Struzik et al.

(10) Patent No.: US 10,182,287 B2
(45) Date of Patent: Jan. 15, 2019

(54) EARPHONE HAVING DAMPED EAR CANAL RESONANCE

(71) Applicant: Bose Corporation, Framingham, MA (US)

(72) Inventors: Ryan C. Struzik, Hopkinton, MA (US); Andrew D. Dominijanni, Newton, MA (US)

(73) Assignee: BOSE CORPORATION, Framingham, MA (US)

( * ) Notice: Subject to any disclaimer, the term of this patent is extended or adjusted under 35 U.S.C. 154(b) by 254 days.

(21) Appl. No.: 15/238,378

(22) Filed: Aug. 16, 2016

(65) Prior Publication Data

US 2018/0054670 A1 Feb. 22, 2018

(51) Int. Cl.

| | |
|---|---|
| ***H04R 1/10*** | (2006.01) |
| ***H04R 1/28*** | (2006.01) |
| ***G10K 11/178*** | (2006.01) |

(52) U.S. Cl.

CPC ..... *H04R 1/2888* (2013.01); *G10K 11/17861* (2018.01); *H04R 1/1016* (2013.01); (Continued)

(58) Field of Classification Search

CPC .. H04R 1/2888; H04R 1/1016; H04R 1/1075; H04R 1/2857; H04R 2410/05; (Continued)

(56) References Cited

U.S. PATENT DOCUMENTS

| | | | |
|---|---|---|---|
| 4,006,321 | A | 2/1977 | Carlson |
| 4,807,612 | A | 2/1989 | Carlson |

(Continued)

FOREIGN PATENT DOCUMENTS

| | | | |
|---|---|---|---|
| EP | 2768239 | A1 | 8/2014 |
| EP | 3214852 | A1 | 9/2017 |

(Continued)

OTHER PUBLICATIONS

International Search Report & Written Opinion in International Patent Application No. PCT/US17/43036, dated Sep. 28, 2017; 16 pages.

*Primary Examiner* — Sean H Nguyen
(74) *Attorney, Agent, or Firm* — Schmeiser, Olsen & Watts LLP; William G. Guerin

(57) ABSTRACT

An earphone includes an electro-acoustic transducer and an earphone assembly. The electro-acoustic transducer is configured to generate an acoustic signal in response to an electrical signal. The earphone assembly has an inner surface and an earphone acoustic opening. The electro-acoustic transducer is disposed inside the earphone assembly and defines a front cavity between the electro-acoustic transducer and the earphone acoustic opening along a first portion of the inner surface and a back cavity between the electro-acoustic transducer and a second portion of the inner surface. The earphone assembly further includes an acoustic impedance branch having an impedance aperture in acoustic communication with the front cavity. The acoustic impedance branch includes an acoustic resistive element and a branch volume that reduce a resonance at a first resonance frequency for an occluded ear canal defined by the front cavity of the earphone assembly and an ear canal of a user.

17 Claims, 5 Drawing Sheets

(52) U.S. Cl.
CPC ..... *H04R 1/1075* (2013.01); *H04R 1/2857* (2013.01); *H04R 1/2873* (2013.01); *G10K 2210/1081* (2013.01); *G10K 2210/3224* (2013.01); *H04R 1/1083* (2013.01); *H04R 1/288* (2013.01); *H04R 2410/05* (2013.01); *H04R 2460/05* (2013.01)

(58) Field of Classification Search
CPC ..... H04R 2460/05; H04R 2410/04; H04R 1/2873; H04R 1/1083; H04R 1/288; G10K 11/17861; G10K 2210/1081; G10K 2210/3224
USPC ..... 381/353
See application file for complete search history.

(56) References Cited

U.S. PATENT DOCUMENTS

| | | | | |
|---|---|---|---|---|
| 8,081,769 | B2 | 12/2011 | Fukuda et al. | |
| 8,238,568 | B2 | 8/2012 | Miseki et al. | |
| 9,934,774 | B1 * | 4/2018 | Lin | H04R 1/1016 |
| 2012/0294465 | A1 | 11/2012 | Vlach et al. | |
| 2016/0192065 | A1 * | 6/2016 | Oosato | H04R 1/2826 381/378 |

FOREIGN PATENT DOCUMENTS

| | | | |
|---|---|---|---|
| GB | 2408405 | A | 5/2005 |
| GB | 2454605 | A | 5/2009 |
| WO | 2007089845 | A2 | 8/2007 |

* cited by examiner

EARPHONE HAVING DAMPED EAR CANAL RESONANCE

BACKGROUND

This disclosure relates to an in-ear audio device having improved performance. More particularly, the audio device includes an earphone assembly having an acoustic impedance branch that dampens the resonance of the occluded ear canal formed between the front cavity of an earphone assembly and the ear canal of a user.

SUMMARY

In one aspect, an earphone includes an electro-acoustic transducer and an earphone assembly. The electro-acoustic transducer is configured to generate an acoustic signal in response to an electrical signal. The earphone assembly has an inner surface and an earphone acoustic opening. The electro-acoustic transducer is disposed inside the earphone assembly and defines a front cavity between the electro-acoustic transducer and the earphone acoustic opening along a first portion of the inner surface and a back cavity between the electro-acoustic transducer and a second portion of the inner surface. The earphone assembly further includes an acoustic impedance branch having an impedance aperture in acoustic communication with the front cavity. The acoustic impedance branch includes an acoustic resistive element and a branch volume that reduce a resonance at a first resonance frequency for an occluded ear canal defined by the front cavity of the earphone assembly and an ear canal of a user when the earphone is at least partially inserted into the ear canal.

Examples may include one or more of the following features:

The acoustic resistive element may be disposed at the impedance aperture. The acoustic resistive element may include a planar acoustic resistive element. The planar acoustic resistive element may be an acoustic screen, a wire mesh or an acoustic fabric. The acoustic resistive element may be a volume acoustic resistive element disposed in at least a portion of the branch volume. The volume acoustic resistive element may include a foam element.

An acoustic resistance of the acoustic resistive element and the branch volume may provide an acoustic attenuation having a corner frequency that is substantially equal to the first resonance frequency.

The impedance aperture may be an opening in a portion of the earphone body that separates the front cavity and the acoustic impedance branch.

The earphone may further include an acoustic channel that extends from the front cavity to the branch volume.

An acoustic resistance of the acoustic resistive element, the branch volume, and dimensions of the acoustic channel may result in a Helmholtz acoustic resonance frequency that is substantially equal to the first resonance frequency.

The branch volume of the acoustic impedance branch may include an acoustic waveguide having a first waveguide resonance frequency that is substantially equal to the first resonance frequency. The acoustic waveguide may have a cross-sectional area that is constant along the length of the acoustic waveguide and the length may be substantially equal to a quarter wavelength of an acoustic wavelength at the first resonance frequency. The acoustic waveguide may have a cross-sectional area that varies along the length of the acoustic waveguide. The acoustic waveguide may be formed as a channel in the earphone assembly. The acoustic waveguide may include a foam element.

The earphone assembly may include a rigid body and a compliant eartip. The acoustic impedance branch may be in the rigid body or in the compliant eartip. Alternatively, the acoustic impedance branch may be in the rigid body and the compliant eartip.

In accordance with another aspect, an acoustic noise reduction earphone includes an electro-acoustic transducer, an earphone assembly, a circuit and at least one of a feedforward microphone and a feedback microphone. The electro-acoustic transducer is configured to generate an acoustic signal in response to a received electrical signal and the earphone assembly has an inner surface, an external surface and an earphone acoustic opening. The electro-acoustic transducer is disposed inside the earphone assembly and defines a front cavity between the electro-acoustic transducer and the earphone acoustic opening along a first portion of the inner surface and a back cavity between the electro-acoustic transducer and a second portion of the inner surface. The earphone assembly further includes an acoustic impedance branch having an impedance aperture in acoustic communication with the front cavity. The acoustic impedance branch includes an acoustic resistive element and a cavity volume that reduce a resonance at a first resonance frequency for an occluded ear canal defined by the front cavity of the earphone assembly and an ear canal of a user when the earphone is at least partially inserted into the ear canal. The feedforward microphone is disposed on the external surface of the earphone and configured to generate a feedforward electrical signal in response to external acoustic noise. The feedback microphone is disposed in the front cavity of the earphone and configured to generate a feedback electrical signal in response to a front cavity acoustic signal. The circuit is in electrical communication with the electro-acoustic transducer and the at least one of a feedforward microphone and feedback microphone. The circuit generates the electrical signal received by the electro-acoustic transducer in response to at least one of the feedback electrical signal and the feedforward electrical signal.

Examples may include one or more of the following features:

An acoustic resistance of the acoustic resistive element and the branch volume may provide an acoustic attenuation having a corner frequency that is substantially equal to the first resonance frequency.

The impedance channel may include an acoustic channel that extends from the front cavity to the branch volume.

An acoustic resistance of the acoustic resistive element, the branch volume and dimensions of the acoustic channel may result in a Helmholtz acoustic resonance frequency that is substantially equal to the first resonance frequency.

The branch volume of the acoustic impedance branch may include an acoustic waveguide having a first waveguide resonance frequency that is substantially equal to the first resonance frequency.

BRIEF DESCRIPTION OF THE DRAWINGS

The above and further advantages of examples of the present inventive concepts may be better understood by referring to the following description in conjunction with the accompanying drawings, in which like numerals indicate like structural elements and features in various figures. The drawings are not necessarily to scale, emphasis instead being placed upon illustrating the principles of features and implementations.

DETAILED DESCRIPTION

Figure 1:
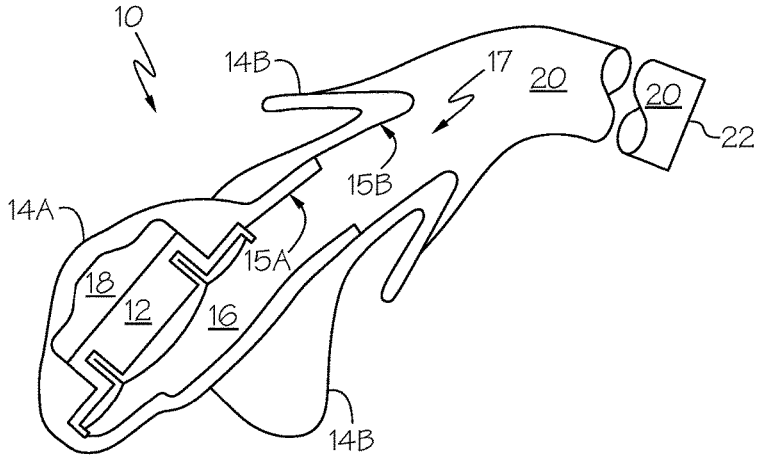
FIG. 1 (PRIOR ART)
FIG. 1 is an illustration of a typical in-ear audio device inserted into an ear canal so as to form an occluded ear canal.

As shown in FIG. 1, a typical in-ear audio device, such as an earphone 10, includes an electro-acoustic transducer 12 (e.g., speaker) inside an earphone assembly 14. The earphone assembly 14 includes a rigid body 14A and a compliant eartip 14B. The rigid body 14A may be formed as a hard plastic material. For example, the material may be a thermoplastic polymer such as acrylonitrile butadiene styrene ("ABS"). The earphone assembly 14 has an inner surface 15 and an acoustic opening 17. The inner surface 15 includes the inner surface 15A of the rigid body 14A and the internal surface 15B of the eartip 14B, and the acoustic opening 17 is at the open end of the eartip 14B. The eartip 14B is formed of a material that comfortably conforms to the entrance of an ear canal 20 of a user, such as silicone. The eartip 14B may be configured for removal from and reattachment to the rigid body 14A. The speaker 12 is disposed inside the rigid body 14A such that an acoustic front cavity 16 is defined on the front side of the speaker 12 and an acoustic back cavity 18 is defined on the back side of the speaker 12. The acoustic back cavity 18 may be sealed, as shown, or it may be shunted (i.e., "ported") by way of one or more acoustic impedance paths to an external acoustic environment, to the front cavity 16, or to both the external acoustic environment and front cavity 16. Although not shown, the earphone 10 may include one or more feedback microphones located in the front cavity 16 and/or one or more feedforward microphones which are typically disposed on the external surface of the rigid body 14A.

As illustrated, the speaker 12 is provided at an acute angle with respect to a length of the front cavity 16 which extends from a region adjacent to the speaker 12 to the acoustic opening. In other examples, the speaker 12 is located at the end of the rigid body 14A such that the acoustic energy from the speaker is directed substantially along the length of the front cavity 16.

The front cavity 16 is an open cavity while the earphone 10 is not worn; however, when the earphone 10 is inserted into the entrance of the ear canal 20, the front cavity 16 and the ear canal 20 couple together to form an acoustic cavity referred to as an occluded ear canal. The occluded ear canal behaves substantially as an acoustic waveguide. The ear drum 22 is located at one end of the occluded ear canal and the speaker 12 and front cavity 16 are located at the other end of the occluded ear canal. The figure omits most of the length of the ear canal to accommodate for scale and for clarity of the illustrated features. By way of example, the length of the ear canal of a user is typically in a range from about 2 cm to 3 cm.

A rigidly terminated acoustic waveguide is known to have a first resonance at a frequency where the length of the waveguide is equal to a half-wavelength of propagating acoustic waves. This first resonance frequency depends on several factors, including, but not limited to, the length of the ear canal, the earphone insertion depth and the volume of the front cavity 16. For typical earphones the first resonance frequency is in a frequency range extending from about 4 KHz to about 8 KHz.

The first resonance of the occluded ear canal causes undesirable effects for a number of reasons. First, for passive noise-isolating earphones and active noise reduction (ANR) earphones, the resonance amplifies the transmission of external noise into the ear canal and therefore reduces the amount of passive noise attenuation around the first resonance frequency. The reduced attenuation is particularly noticeable in ANR earphones because the active components of noise reduction typically include a feedback system and feedforward system, both of which contribute to noise reduction primarily at frequencies below the first resonance frequency. Consequently, the total noise reduction is greatest at frequencies below the first resonance frequency, small around the resonance frequency, and moderate at frequencies that are greater than the resonance frequency. It should be recognized that there are higher order resonances defined by the occluded ear canal; however, these resonances occur at higher frequencies where hearing is less sensitive and these resonances interact with other dynamic features so their effects are not as consistently prominent as the first resonance.

Figure 2:
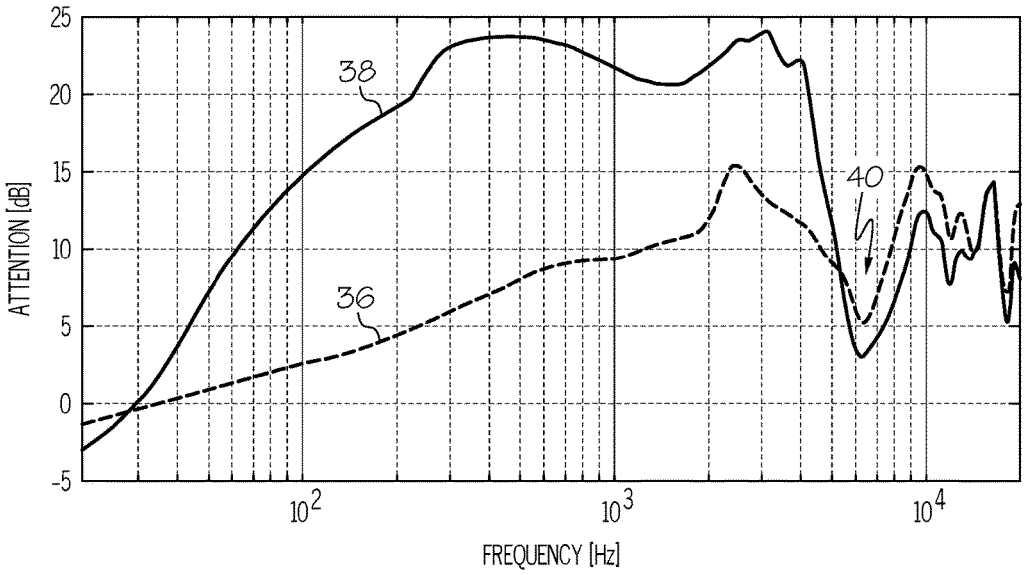
FIG. 2 is a graphical representation of an example of the passive attenuation and total attenuation of an acoustic noise reduction earphone as a function of acoustic frequency.

FIG. 2 shows an example of the noise attenuation achieved by an ANR earphone as a function of acoustic frequency. A typical ANR earphone system includes one or more feedforward microphones disposed on the external surface of the earphone, one or more feedback microphones disposed in the front cavity of the earphone and circuitry in electrical communication with the microphones. The circuitry generates an electrical signal to drive the speaker based, for example, on an audio playback signal. The electrical signal is also responsive to the feedback and feedforward electrical signals generated by the microphones that are used for noise reduction.

The figure shows the attenuation as a function of acoustic frequency. Total attenuation 38 represents the sum of the active (i.e. feedback and/or feedforward) attenuation and the passive attenuation 36. The negative effect of the ear canal resonance on the passive attenuation 36, and therefore on the total attenuation 38, is evident as the "notch" 40 at approximately 7 KHz.

It should be noted that a second undesirable effect of the occluded ear canal resonance is the amplification of the speaker response at and around the resonance frequency, which is generally problematic for audio playback.

Examples of earphones described below include an impedance branch in acoustic communication with the front cavity of the earphone to effectively modify the boundary condition of the waveguide defined by the occluded ear canal. The acoustic impedance branch yields a reduction in the undesirable effects from the first resonance frequency. Consequently, the quality factor (Q) of the occluded ear canal is reduced and a substantially flatter spectral audio response is achieved.

Figure 3:
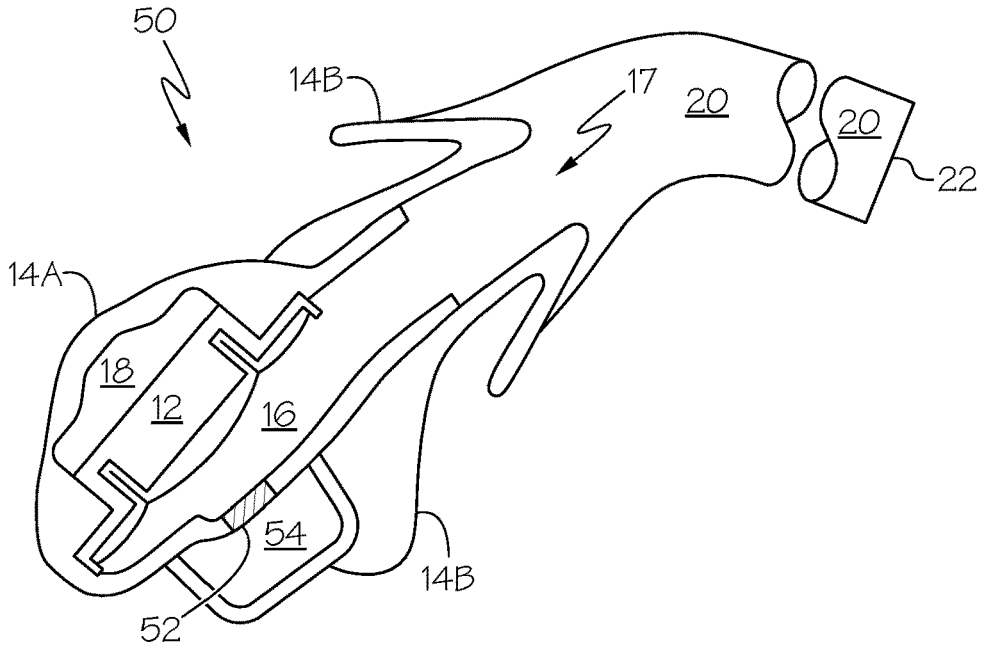
FIG. 3 is an illustration of an example of an earphone having an acoustic circuit that includes an acoustic impedance branch.

FIG. 3 shows an example of an earphone 50 in which an acoustic circuit, defined in part by the acoustic impedance branch, acts in an analogous way to an electronic series resistor and capacitor (RC) circuit. In particular, the acoustic impedance branch includes an acoustic resistive element 52. The acoustic impedance branch also includes a "branch volume" cavity 54 which acts as a capacitance or compliance in the acoustic circuit. Examples of acoustic resistive elements 52 include an acoustic screen, a wire mesh, an acoustic fabric and other substantially planar acoustic resistive elements. In one specific example, the acoustic resistive element 52 is Saati Acoustex woven mesh available from Saati Americas Corporation of Fountain Inn, S.C. The acoustic resistive element 52 is located at an impedance aperture where the front cavity 16 is in communication with the branch volume 54.

The acoustic RC circuit has a corner frequency $f_c$ at which the impedance magnitudes of the acoustic resistance and acoustic capacitance are equal. When the corner frequency $f_c$ is set to be approximately equal to the first resonance frequency of the occluded ear canal, the acoustic resistance and acoustic capacitance are in balance to allow acoustic energy into the acoustic impedance branch and to dissipate that acoustic energy. Although the corner frequency $f_c$ is set to be approximately equal to (i.e., substantially equal to) the first resonance frequency, the acoustic RC circuit may be detuned by a small frequency offset so that the two frequencies are not exactly equal. For example, the corner frequency $f_c$ can be tuned to a value within a 20% range of the first resonance frequency (i.e., at a frequency that is 1.8 to 2.2 times the first resonance frequency). If the corner frequency $f_c$ is detuned to be slightly less than the first resonance frequency, the effective first resonance of the occluded ear canal may shift to a frequency that is closer to the second resonance of the open ear. It will be recognized in connection with alternative examples described below that similar detuning with respect the first resonance yields similar beneficial effects.

As a result of the acoustic RC circuit, the Q of the first resonance is reduced. The size of the branch volume 54 relative to the volume of the occluded ear canal substantially determines how much the Q is reduced. By way of example, the branch volume 54 may be less than 0.02 $cm^3$ to more than 0.2 $cm^3$ while the volume of the occluded ear canal is dependent on the volume of an "open" ear canal (typically in a range between about 1.0 $cm^3$ and 1.4 $cm^3$), the insertion depth of the earphone and the volume of the front cavity.

In one non-limiting numerical example, the branch volume 54 is 0.05 $cm^3$, the impedance aperture has a radius of 1.2 mm and the acoustic resistive element 52 is an acoustic screen having an acoustic resistance of 260 rayl.

Figure 4:
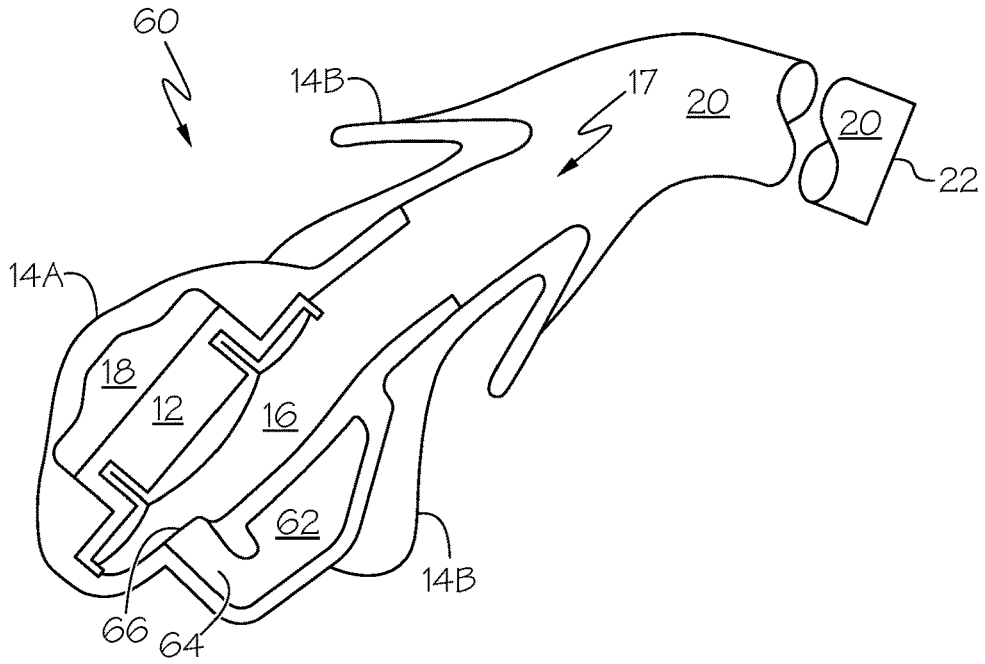
FIG. 4 is an illustration of another example of an earphone having an acoustic circuit that includes an acoustic impedance branch.

FIG. 4 shows an example of an earphone 60 in which an acoustic circuit defined by the acoustic impedance branch acts in a similar way to an electrical resistor, inductor and capacitor (RLC) circuit. The acoustic impedance branch includes a branch volume 62, an acoustic channel 64 (e.g. a thin tube) extending from the branch volume 62 to the front cavity 16, and an acoustic resistive element 66. The acoustic channel 64 acts as an inductor or mass and the branch volume 62 acts as a capacitance or compliance. This type of circuit is commonly referred to as a Helmholtz Resonator and has a resonance frequency $f_{hr}$.

The acoustic resistive element 66 may be at the impedance aperture defined at the boundary between the front cavity 16 and the acoustic port as shown in the figure or may be located at the boundary between the acoustic channel 64 and the branch volume 62. Alternatively, or in addition, an acoustic resistive element may be a volume acoustic resistive element disposed in at least a portion of the acoustic channel 64. For example, an acoustically resistive foam may be provided which partially or fully occupies the acoustic channel 64. By way of a specific example, the acoustically resistive foam may be Melamine foam.

When the acoustic Helmholtz Resonator frequency $f_{hr}$ is tuned appropriately with respect to the first resonance frequency of the occluded ear canal (e.g., within a frequency offset range that is within 20% of the first resonance frequency), a significant reduction in the first resonance occurs. Analogous systems are often used to manage mechanical vibrations and are referred to as tuned mass dampers or damped vibration absorbers where such systems are tuned to damp vibrations as is known in the mechanical arts. It should be recognized that the structure of the ear canal can vary for different users. Consequently, an earphone assembly that may be optimally configured for one user may be mistuned for another user so that the damping of the first resonance is less.

In one non-limiting numerical example, the branch volume 62 is 0.052 $cm^3$, the impedance aperture has a radius of 1.0 mm, the acoustic channel 64 has a length of 2.5 mm and the acoustic resistive element 66 is an acoustic screen having an acoustic resistance of 140 rayl.

In an alternative example to the Helmholtz Resonator configuration, a waveguide can be used in place of the acoustic channel and branch volume. For example, the waveguide may be formed as a channel in the rigid body 14A of the earphone assembly 14. The waveguide may have a constant cross-sectional area. Alternatively, the waveguide may have a cross-sectional area that varies along its length, for example a conical or an exponential waveguide. To reduce the first resonance of the occluded ear canal, the length of the waveguide may be tuned to have a first resonance frequency that is approximately equal to the first resonance frequency of the occluded ear canal. For example, the length of a constant-area waveguide may be approximately one quarter of the wavelength for the expected first resonance frequency.

Figure 5:
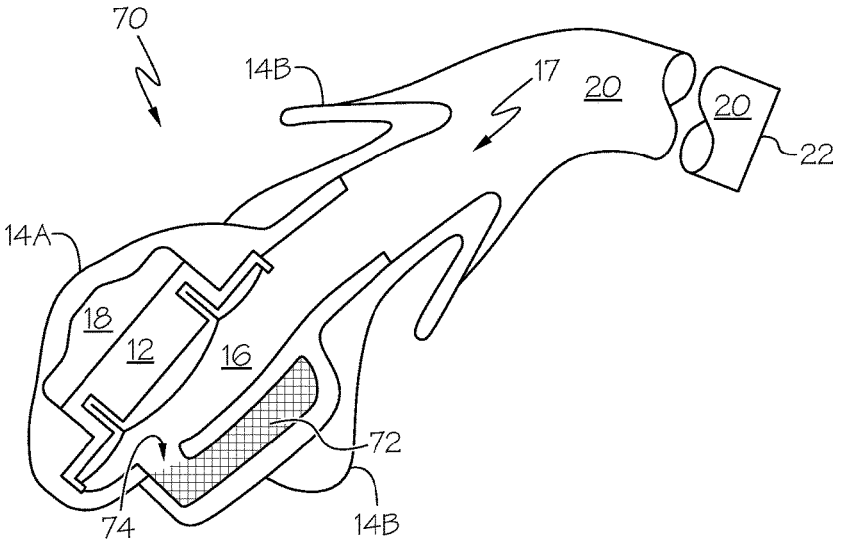
FIG. 5 is an illustration of an example of an earphone having a foam shunt acoustically coupled to a front cavity of the earphone.

FIG. 5 shows an example of an earphone 70 in which a foam shunt 72 is acoustically coupled at the impedance aperture 74 to the front cavity 16 while the remainder of the foam shunt 72 is surrounded by the rigid body 14A. The foam shunt 72 acts as a fluid having a density and speed of sound which are generally complex-valued parameters in which the imaginary component is associated with an acoustic resistance. An appropriate foam has an acoustic resistance that is sufficient to allow acoustic energy to couple into the acoustic impedance branch and to dissipate the coupled acoustic energy. Melamine foam is one example of a foam that may be used to form the foam shunt 72.

In a variation of the illustrated example, the foam shunt 72 can have a geometric form such that the foam shunt 72 acts as a waveguide having a first resonance tuned approximately equal to the first resonance frequency of the occluded ear canal. The waveguide may have constant or varying cross-sectional area along its length. In this configuration, the foam shunt 72 acts as a tuned mass damper that significantly reduces the Q of the first resonance.

Figure 6:
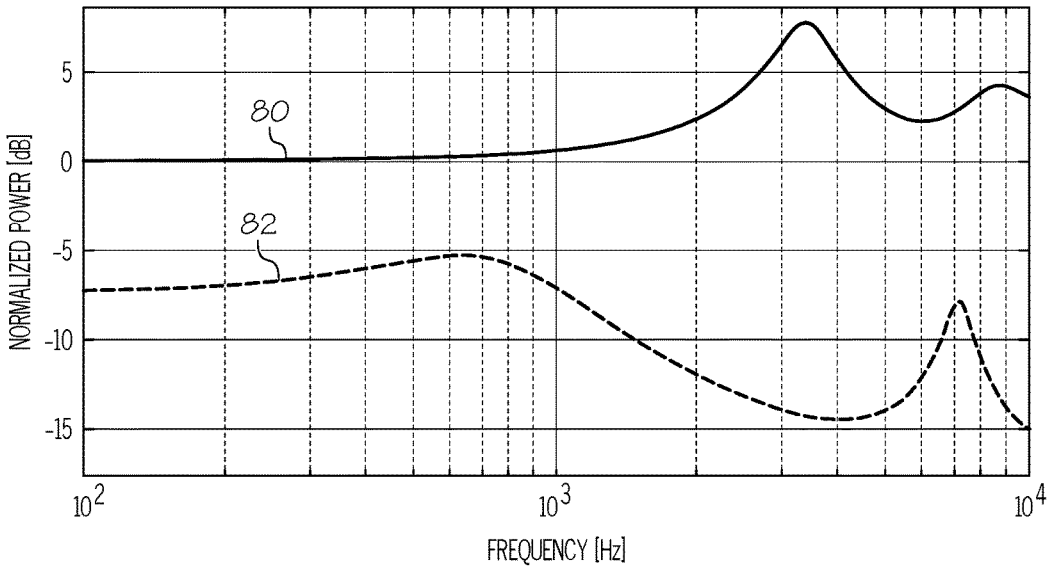
FIG. 6 is a graphical representation of an example of acoustic power received at an eardrum as a function of acoustic frequency for an open ear canal and for an ear canal occluded by an earphone providing only passive attenuation.

The earphone examples described above illustrate how the Q, and as a result the undesirable effects, of the first resonance of an occluded ear canal on the passive noise attenuation can be reduced. An example of passive attenuation as a function of acoustic frequency is shown in FIG. 6 in which one response 80 corresponds to acoustic power received at the ear drum as a function of acoustic frequency for an open ear canal and the other response 82 corresponds to the acoustic power received at the ear drum as a function of acoustic frequency while a nominal earphone providing only passive attenuation is inserted into the entrance of the ear canal. The amount of passive attenuation is defined as the difference between the two responses 80 and 82. The passive attenuation corresponds to a diffuse noise field and the responses are normalized to the acoustic power received at the ear drum for the open ear canal at zero frequency. The first resonance frequency is evident in the inserted earphone curve at a frequency of approximately 7 KHz.

Figure 7:
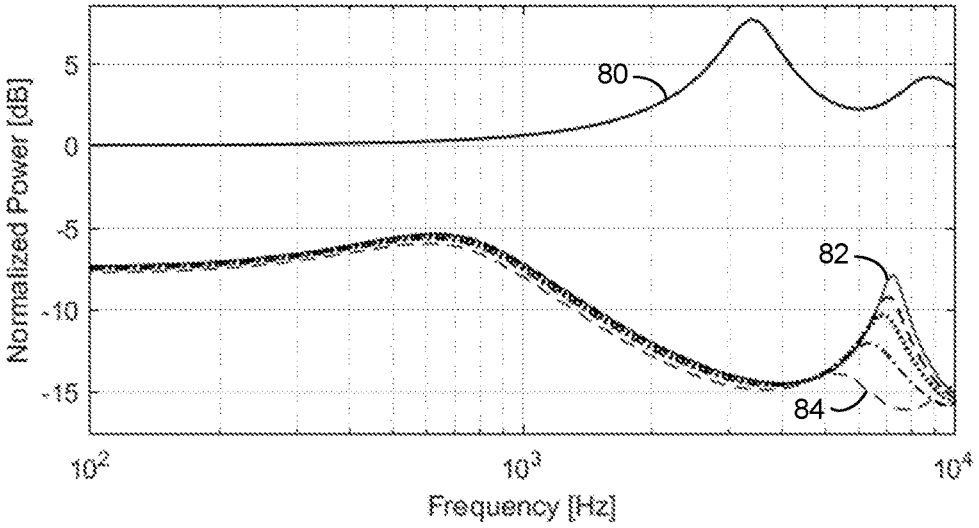
FIG. 7 is a graphical representation of an example of the normalized acoustic power at the ear drum as a function of acoustic frequency for an open ear, an ear canal occluded by an earphone having only passive attenuation and for an ear canal occluded by an earphone configured according to FIG. 3 for four different branch volumes.

FIG. 7 graphically shows the normalized acoustic power at the ear drum as a function of acoustic frequency for the open ear and nominal passive attenuation earphone (responses 80 and 82, respectively) as described above with respect to FIG. 6. FIG. 7 also shows the acoustic power at the eardrum as a function of acoustic frequency for four different earphones with each earphone configured with an acoustic impedance branch having a planar acoustic resistive element and a branch cavity as described above for FIG. 3. The four earphones have branch volumes of 0.025 $cm^3$, 0.05 $cm^3$, 0.10 $cm^3$ and 0.20 $cm^3$. It can be seen that the first resonance decreases monotonically both in magnitude and in acoustic frequency with increasing values of branch volume with the response 84 corresponding to the branch volume of 0.20 $cm^3$. An upper limit to the branch volume typically is due to the available space within the earphone body.

Figure 8:
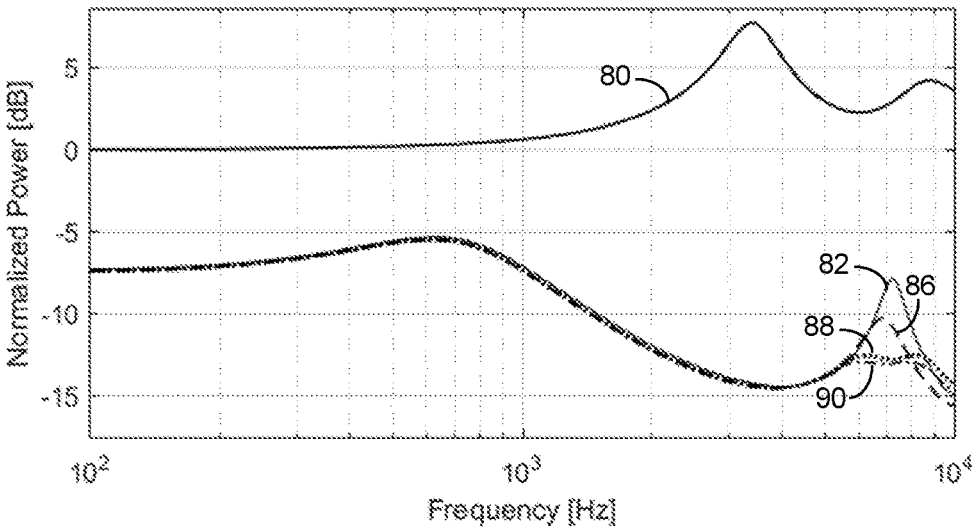
FIG. 8 is a graphical representation of an example of the normalized acoustic power at the ear drum as a function of acoustic frequency for an open ear, an ear canal occluded by a nominal passive attenuation earphone and for ear canals occluded by an earphone configured according to one of FIG. 3, FIG. 4 and FIG. 5 with a branch volume of 0.05 $cm^3$.

FIG. 8 graphically shows the normalized acoustic power at the ear drum as a function of acoustic frequency for the open ear and nominal passive attenuation earphone (responses 80 and 82, respectively) as described above with respect to FIG. 6. FIG. 8 also shows the acoustic power at the eardrum as a function of acoustic frequency for an earphone constructed according to the acoustic screen and branch volume configuration of FIG. 3, the Helmholtz Resonator configuration of FIG. 4 and the foam resonator configuration of FIG. 5 (responses 86, 88 and 90, respectively). All branch volumes are 0.05 $cm^3$.

One significant advantage of various examples of earphones described above relates to the ability to control, and specifically, flatten, the amplification of the speaker response in the feedback system. More specifically, a feedback controller can include frequency response features that remove the amplifying effect of the ear canal resonance on the speaker-to-feedback microphone response. Decreasing the magnitude of the resonance with an acoustic impedance branch permits a more robust feedback system to accommodate the effects of an occluded ear canal resonance.

Figure 9:
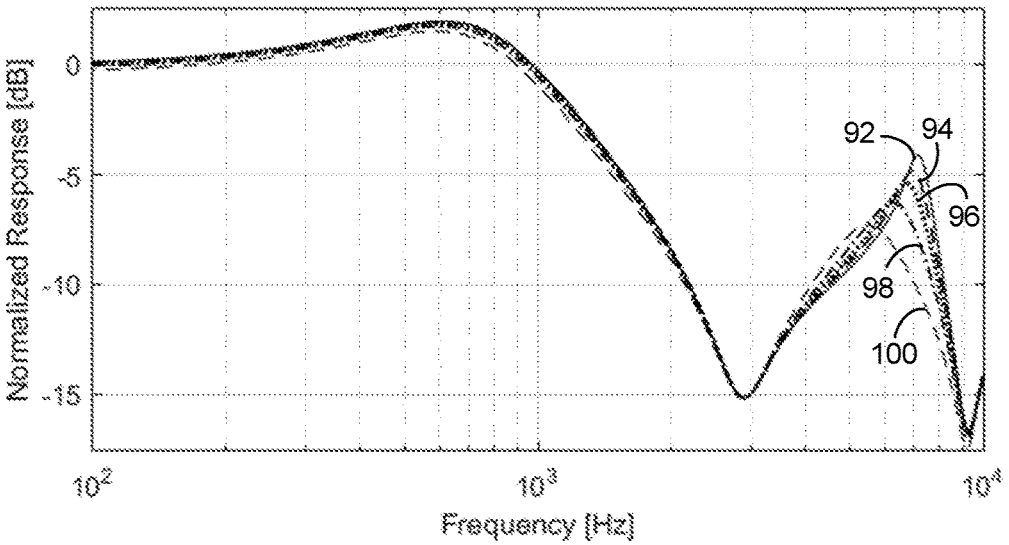
FIG. 9 is a graphical representation of a normalized speaker-to-feedback microphone response showing how the response improves with increasing branch volume of an acoustic impedance branch.

FIG. 9 is an example of how the speaker-to-feedback microphone response improves with increasing branch volume. Response 92 corresponds to a nominal passive-only attenuating earphone and responses 94, 96, 98 and 100 correspond to branch volumes of 0.025 $cm^3$, 0.05 $cm^3$, 0.01 $cm^3$ and 0.20 $cm^3$, respectively.

As described above, in some earphones the acoustic back cavity 18 (see FIG. 3) may be shunted (ported) by an impedance path to the acoustic front cavity 16. Furthermore, the front cavity 16 may be shunted to the external acoustic environment. Such ports may be used for low frequency pressure equalization and referred to as PEQ ports. For example, a PEQ port may be implemented as a narrow tube. Alternatively, one or more PEQ ports may shunt between the acoustic impedance branch and the back cavity 18 and/or between the acoustic impedance branch and the external acoustic environment. These alternative configurations are possible because the acoustic impedance branch is in acoustic communication with the front cavity 16 and may be configured to be effectively open to the front cavity 16 below several kHz. Consequently, low frequency acoustic energy from the PEQ port(s) passes through the acoustic impedance branch to the front cavity 16 and vice versa. In addition, PEQ ports may be configured to be effectively closed above several hundred Hz. Thus the PEQ ports have no substantial influence on the effect of the acoustic impedance branch on the first resonance of the occluded ear canal.

Although the various examples described above include the acoustic impedance branch as located within the rigid body of an earphone assembly, in alternative examples the acoustic impedance branch is partially or fully located in the eartip. For example, part of the branch cavity or the entire branch cavity may be formed in the eartip.

A number of implementations have been described. Nevertheless, it will be understood that the foregoing description is intended to illustrate, and not to limit, the scope of the inventive concepts which are defined by the scope of the claims. For example, examples described above include a single acoustic impedance branch; however, in other examples, two or more acoustic impedance branches are used. Other examples are within the scope of the following claims.

What is claimed is:

1. An acoustic noise reduction earphone comprising:

an electro-acoustic transducer configured to generate an acoustic signal in response to a received electrical signal; and an earphone assembly having an inner surface, an external surface and an earphone acoustic opening, the electro-acoustic transducer being disposed inside the earphone assembly and defining a front cavity between the electro-acoustic transducer and the earphone acoustic opening along a first portion of the inner surface and a back cavity between the electro-acoustic transducer and a second portion of the inner surface, the earphone assembly further including an acoustic impedance branch having an impedance aperture in acoustic communication with the front cavity and wherein the acoustic impedance branch includes an acoustic resistive element and a cavity volume that detunes a resonance from a first resonance frequency for an occluded ear canal defined by the front cavity of the earphone assembly and an ear canal of a user when the earphone is at least partially inserted into the ear canal, the first resonance frequency being detuned by an offset frequency to a value within a range from about 1.8 times the first resonance frequency to about 2.2 times the first resonance frequency;

at least one of a feedforward microphone disposed on the external surface of the earphone and configured to generate a feedforward electrical signal in response to external acoustic noise and a feedback microphone disposed in the front cavity of the earphone and configured to generate a feedback electrical signal in response to a front cavity acoustic signal; and a circuit in electrical communication with the electroacoustic transducer and the at least one of a feedforward microphone and feedback microphone, the circuit generating the electrical signal received by the electroacoustic transducer in response to at least one of the feedback electrical signal and the feedforward electrical signal.

2. The earphone of claim 1 wherein the acoustic resistive element comprises a planar acoustic resistive element.

3. The earphone of claim 2 wherein the planar acoustic resistive element is one of an acoustic screen, a wire mesh, and an acoustic fabric.

4. The earphone of claim 1 wherein the acoustic resistive element is a volume acoustic resistive element disposed in at least a portion of the branch volume.

5. The earphone of claim 2 wherein the volume acoustic resistive element comprises a foam element.

6. The earphone of claim 1 wherein the earphone assembly includes a rigid body and a compliant eartip.

7. The earphone of claim 6 wherein the acoustic impedance branch is in the rigid body.

8. The earphone of claim 6 wherein the acoustic impedance branch is in the compliant eartip.

9. The earphone of claim 6 wherein the acoustic impedance branch is in the rigid body and the compliant eartip.

10. The earphone of claim 1 wherein an acoustic resistance of the acoustic resistive element and the branch volume provide an acoustic attenuation having a corner frequency that is substantially equal to the first resonance frequency.

11. The earphone of claim 1 wherein the impedance aperture comprises an acoustic channel that extends from the front cavity to the branch volume.

12. The earphone of claim 11 wherein an acoustic resistance of the acoustic resistive element, the branch volume and dimensions of the acoustic channel result in a Helmholtz acoustic resonance frequency that is substantially equal to the first resonance frequency.

13. The earphone of claim 1 wherein the branch volume of the acoustic impedance branch comprises an acoustic waveguide having a first waveguide resonance frequency that is substantially equal to the first resonance frequency.

14. The earphone of claim 13 wherein the acoustic waveguide has a cross-sectional area that is constant along the length of the acoustic waveguide and wherein the length is substantially equal to a quarter wavelength of an acoustic wavelength at the first resonance frequency.

15. The earphone of claim 13 wherein the acoustic waveguide has a cross-sectional area that varies along the length of the acoustic waveguide.

16. The earphone of claim 13 wherein the acoustic waveguide is formed as a channel in the earphone assembly.

17. The earphone of claim 13 wherein the acoustic waveguide comprises a foam element.

* * * * *